US006314904B1

(12) United States Patent
Elvestad

(10) Patent No.: US 6,314,904 B1
(45) Date of Patent: Nov. 13, 2001

(54) COLLAPSIBLE CANOE

(76) Inventor: Alf J. Elvestad, P.O. Box 700, Enfield, NH (US) 03748

( * ) Notice: Subject to any disclaimer, the term of this patent is extended or adjusted under 35 U.S.C. 154(b) by 0 days.

(21) Appl. No.: 09/689,284

(22) Filed: Oct. 11, 2000

(51) Int. Cl.[7] ..... B63B 35/71
(52) U.S. Cl. ..... 114/347; 114/354
(58) Field of Search ..... 114/347, 354

(56) References Cited

U.S. PATENT DOCUMENTS

| | | | | |
|---|---|---|---|---|
| 4,274,170 | * | 6/1981 | Simpson | 114/347 |
| 5,615,634 | | 4/1997 | Gonda | 114/354 |
| 5,915,327 | * | 6/1999 | Elvestad | 114/354 |
| 5,964,178 | | 10/1999 | Gonda | 114/354 |

* cited by examiner

*Primary Examiner*—Jesus D. Sotelo

(74) *Attorney, Agent, or Firm*—Michael J. Weins; Jeffrey E. Semprebon

(57) ABSTRACT

A collapsible canoe has a frame which includes a pair of gunwales connected together at each end by a gunwale terminator, a thwart separating the gunwales, a series of ribs connected to the gunwales, a keel stringer and supplemental bottom stringers traversing the ribs, and a pair of stem elements attached to the keel stringer. The collapsible canoe also has a skin covering the frame which has two gunwale sleeves which engage the gunwales, side panels attached to the gunwale sleeves, a bottom panel attached to the side panels, and a pair of terminator panels connecting the side panels to each other and to the bottom panel. The skin may be tensioned by inflatable compartments between the frame and the skin. The skin may alternatively be tensioned by the ribs. In one embodiment, a prong attached to each stem element engages a slot in each terminator panel to stabilize the stem elements with respect to the gunwale terminators. In another embodiment, a strap attached to each terminator panel is adjustably engaged with an anchor member which is affixed to each stem element to stabilize the stem elements with respect to the gunwale terminators.

18 Claims, 10 Drawing Sheets

COLLAPSIBLE CANOE

FIELD OF THE INVENTION

The present invention relates to a collapsible canoe which facilitates assembly without compromising the integrity of the assembled canoe.

BACKGROUND OF THE INVENTION

Collapsible canoes have been available for many years. One early canoe which was well suited for packing is described in U.S. Pat. No. 4,290,157. More recently, collapsible canoes which offer improvements on the design of the '157 canoe have been developed and marketed by ScanSport, Inc. Another collapsible canoe is described in U.S. Pat. Nos. 5,615,634 and 5,964,178.

FIGS. 1 through 4 illustrate a prior art collapsible canoe 10 which represents an earlier design marketed by ScanSport, Inc. The collapsible canoe 10 has a frame 12 which includes a pair of gunwales 14, each having a bow end 16 and a stern end 17. A pair of gunwale terminators 18 connect the bow ends 16 of each of the gunwales 14 together and connect together the stem ends 17 of each of the gunwales 14.

The frame 12 also includes a series of ribs 20, each attached to the gunwales 14 with gunwale-engaging clips 22, one of which is shown in detail in FIG. 2. At least one thwart 24 is connected to the gunwales 14 to maintain a separation therebetween. In the collapsible canoe 10 illustrated, the thwart 24 is attached to the rib 20', and is connected to the gunwales 14 thereby.

The frame 12 has a keel stringer 26, which traverses the ribs 20. The frame 12 also has supplemental bottom stringers 28 which traverse the ribs 20 and are symmetrically disposed with respect to the keel stringer 26. The keel stringer 26 and supplemental bottom stringers 28 are engaged by stringer-engaging clips 30 on the ribs 20, and define a bottom region of the frame 12. The stringer-engaging clips 30 limit lateral motion of the keel stringer 26 and the supplemental bottom stringers 28 along the ribs 20, while allowing longitudinal motion normal to the ribs 20.

A pair of stem elements 32 (only one of which is visible) are slidably engaged with and terminate the keel stringer 26. Each of the stem elements 32 extends up to one of the gunwale terminators 18. The supplemental bottom stringers 28 terminate at bottom stringer terminators 34 (as better shown in FIG. 3) which are affixed to the stem elements 32. In combination, the stringer-engaging clips 30 and bottom stringer terminators 34 maintain the supplemental bottom stringers 28 in position.

The collapsible canoe 10 has a skin 36 which covers the frame 12. In the view of FIG. 1, the skin 36 is shown partially cut away to better show the structure of the collapsible canoe 10. The frame 12 supports the skin 36, and also is supported thereby, since the elements of the frame 12 are, for the most part, not secured to each other. Such cooperation between the frame 12 and the skin 36 reduces the number of connectors needed for assembly of the collapsible canoe 10 to simplify assembly and disassembly.

The skin 36 has a pair of gunwale sleeves 38 which engage the gunwales 14 of the frame 12 to secure the skin 36 to the frame 12. Tension of the skin 36 secures the gunwales 14 to the gunwale-engaging clips 22 on the ribs 20. The skin 36 also has a pair of side panels 40 which may be formed integrally with the gunwale sleeves 38, but which are preferably constructed as separate elements to better accommodate the curvature of the frame 12 and to allow the use of a lighter weight fabric for the side panels 40 to minimize weight. A bottom panel 42 is attached to the side panels 40. The side panels 40 are attached to the bottom panel 42 and to each other at two end seam regions 44 (only one of which is shown).

Means for tensioning the skin 36 are provided by a pair of inflatable compartments 46 which reside between the side panels 40 and the frame 12 when the collapsible canoe 10 is assembled. The inflatable compartments 46, when inflated, help maintain the skin 36 tautly in place on the frame 12. The inflatable compartments 46 are preferably removably attached to the skin 36 to facilitate replacement if damaged.

In the collapsible canoe 10, each stem element 32 is provided with means for securing one of the gunwale terminators 18 to the stem element 32. The means for securing one of the gunwale terminators 18 to the stem element 32 are provided by a gunwale terminator securing strap 47 in combination with a vertical stop 48, as better shown in FIG. 4. The gunwale terminator securing strap 47 is attached to the stem element 32, passes over the stem element 32 and around the gunwale terminator 18, and is secured to the vertical stop 48 with snaps 49. The vertical stop 48 is in turn affixed to the stem element 32. The gunwale terminator securing strap 47 binds the gunwale terminator 18 to the stem element 32 to secure it thereto, and the vertical stop 48 limits motion of the gunwale terminator 18 with respect to the stem element 32 as well as securing the gunwale terminator securing strap 47.

While the gunwale terminator securing strap 47 and the vertical stop 48 provide means to secure the gunwale terminator 18 to the stem element 32, it has been found that such securing means are not necessary. Upwards forces on the stem element 32, which are discussed in greater detail below, in combination with tension in the skin 36, serve to secure the stem element 32 with respect to the gunwale terminator 18, making the securing of these elements together by employing additional frame elements unnecessary. Elimination of such additional frame elements simplifies fabrication and assembly/disassembly of the collapsible canoe 10.

FIGS. 5 through 8 illustrate the bow end of another prior art collapsible canoe 50 which represents a more recent model marketed by ScanSport, Inc., and which offers several improvements over the collapsible canoe 10 discussed above. These improvements, which are discussed in greater detail below, may be summarized as follows. The collapsible canoe 50 eliminates the means to secure the gunwale terminator to the stem element and instead connects the gunwale terminator and stem element together using hardware which is identical to that which connects the ribs to the gunwales, which facilitates fabrication of the collapsible canoe 50. The skin of the collapsible canoe 50 is provided with terminator panels at the ends, minimizing leakage of the skin. Finally, the collapsible canoe 50 is provided with inflatable compartment support rods which improve the appearance.

The overall layout of the collapsible canoe 50 is similar to that of the collapsible canoe 10. The stern end of the collapsible canoe 50 (not shown) is similar to the bow end which is illustrated. The collapsible canoe 50 again has a frame 52 which includes a pair of gunwales 54, each having a bow end 56 and a stern end (not shown). A gunwale terminator 58 connects the bow ends 56 of each of the gunwales 54 together.

The frame 52 also includes a series of ribs 60, each of which is attached to the gunwales 54 with gunwale-engaging clips 62. At least one thwart 64 is connected to the gunwales 54 to maintain a separation between the gunwales 54. In the collapsible canoe 50, the thwart 64 is attached to the rib 60', which in turn is attached to the gunwales 54.

The frame 52 has a keel stringer 66 and supplemental bottom stringers 68 which traverse the ribs 60 and are engaged by stringer-engaging clips 70 on the ribs 60. A stem element 72 terminates the keel stringer 66, and extends up to the gunwale terminator 58. The supplemental bottom stringers 68 terminate at bottom stringer terminators 74 which are affixed to the stem element 72.

The collapsible canoe 50 has a skin 76 which covers and supports the frame 52. FIG. 7 is an exploded view of the skin 76. The skin 76 has a pair of gunwale sleeves 78 which engage the gunwales 54 of the frame 52, a pair of side panels 80 attached to the gunwale sleeves 78, and a bottom panel 82 which is attached to the side panels 80. Preferably, the bottom panel 82 is provided with a bottom foam lining 83 to minimize abrasion.

A terminator panel 84 attaches the side panels 80 to each other and to the bottom panel 82. In the collapsible canoe 50, the terminator panel 84 is formed by an extension of the bottom panel 82, to which the side panels 80 are attached. It should be appreciated that the terminator panel 84 could be a separate element, such as a heat sealable tape applied over a seam connecting the side panels 80 and bottom panel 82 together.

Referring again to FIGS. 5 and 6, means for tensioning the skin 76 are again provided by a pair of inflatable compartments 86 which reside between the side panels 80 and the frame 52 when the collapsible canoe 50 is assembled. The inflatable compartments 86, when inflated, help maintain the skin 76 tautly in place on the frame 52. In the collapsible canoe 50, an inflatable compartment support rod 88 is provided on either side of the collapsible canoe 50 to provide longitudinal support for the inflatable compartments 86 to improve the appearance of the collapsible canoe 50.

In the collapsible canoe 50, the stem element 72 is connected to the gunwale terminator 58 by the gunwale-engaging clip 62', which is shown in greater detail in FIG. 8. The gunwale engaging clip 62' limits motion between the gunwale terminator 58 and the stem element 72, but does not secure these elements to each other. As discussed above, securing the stem element 72 to the gunwale terminator 58 is not necessary, since tension of the skin 76 maintains the gunwale terminator 58 secured with the stem element 72.

It has been found that both the collapsible canoe 10 and the collapsible canoe 50 suffer from stresses on the skin (36, 76) which can cause damage to the gunwale sleeves (38, 78). This problem is discussed with regard to the collapsible canoe 50 in reference to FIGS. 5 through 8.

When the collapsible canoe 50 is assembled, the gunwales 54 are inserted into the gunwale sleeves 78, exiting at sleeve ends 90, and are connected together by the gunwale terminator 58. The keel stringer 66, with the stem element 72 attached thereto, is placed in the skin 76 and the gunwale-engaging clip 62' is engaged with the gunwale terminator 58. Each supplemental bottom stringer 68 is attached to one of the bottom stringer terminators 74. The ribs 60 are then installed by engaging the gunwale engaging clips 62 of the rib 60 with the gunwales 54, the gunwale-engaging clips 62 being secured in such engagement by the tension of the skin 76. The supplemental bottom stringers 68 are then moved toward the keel stringer 66 and maintained in position by the stringer engaging clips 70.

As the supplemental bottom stringers 68 are moved toward the keel stringer 66, they exert force on the stem element 72 via the bottom stringer terminators 74, forcing the stem element 72 into the terminator panel 84 of the skin 76. As shown in FIG. 6, the angle of the stem element 72 is less than 90°. As the stem element 72 is forced into the terminator panel 84 with a longitudinal force $F_1$, the angle of the stem element 72 causes a substantial upwards force $F_2$.

A moderate amount of upwards force $F_2$ is desirable, since it maintains the gunwaleengaging clip 62' engaged with the gunwale terminator 58. However, it has been found that the upwards force $F_2$ of the stem element 72 frequently causes stress on the gunwale sleeves 78, since the upwards force $F_2$ is transferred to the gunwales 54 via the gunwale engaging clip 62 and the gunwale terminator 58. This stress on the gunwale sleeves 78 may be great enough to cause failure at the sleeve ends 90 when the collapsible canoe 50 is used in extreme conditions, such as in whitewater rapids and the like. Such failure of the gunwale sleeves 78 has even been found despite additional stitching and reinforcement of the sleeve ends 90.

Again, while not shown, it should be noted that an identical situation exists at the stern end of the collapsible canoe 50.

FIG. 9 is a perspective view of a collapsible canoe 100 such as described in U.S. Pat. Nos. 5,615,634 and 5,964,178, which represents a still more recent development. The collapsible canoe 100 differs from the collapsible canoes discussed above in that it employs a free-standing, isotropically secure frame 102 which is intended to provide structural integrity which is independent of the skin. The frame 102 includes a pair of gunwales 104, each having a bow end 106 and a stem end 108. A pair of gunwale terminators 110 connect the bow ends 106 and the stem ends 108 of each of the gunwales 104 together.

As part of the securing system to provide a free-standing, isotropically secure frame 102, a pair of stem elements 112 are each attached to a keel stringer 114 and extend up to a stem end 116 which is provided with means for securing one of the gunwale terminators 110 to the stem end 116. The means for securing one of the gunwale terminators 110 to the stem end 116 are provided by a gunwale fastener 118 and securing strap 120, which are better shown in the detail view of FIG. 10.

The frame 102 also includes a series of ribs 122, each of which is secured to the gunwales 104 by rib-gunwale lockconnectors 124, one of which is shown in detail in FIGS. 11 and 12. The lockconnectors 124 each have a lockconnector male part 126 which is affixed to the gunwale 104 and a lockconnector female part 128 which is affixed to the rib 122. The rib 122 is installed by fitting the lockconnector female part 128 into engagement with the lockconnector male part 126 and pivoting the rib 122 to lock the lockconnector male part 126 and the lockconnector female part 128 together, as shown in FIG. 12. The interlocking of the lockconnector male part 126 and the lockconnector female part 128 provides a secure connection of the rib 122 to the gunwale 104.

The keel stringer 114 is secured to the ribs 122, as are several longitudinal stringers 130 positioned on the bottom and sides of the frame 102. The frame 102 also has thwarts 132 which are affixed to a selected subset of the ribs 122 to stabilize the gunwales 104.

The collapsible canoe 100 has a skin 134 which covers the frame 102 and is supported thereon. The skin 134 has a pair of gunwale sleeves 136 which engage the gunwales 104 of the frame 102 to secure the skin 134 to the frame 102. The skin 134 also has a pair of side panels 138 attached to the gunwale sleeves 136, and a bottom panel 140 which is attached to the side panels 138. The side panels 138 are attached to each other and to the bottom panel 140 at a bow seam region 142 and a stem seam region 144.

In the collapsible canoe 100 of the '634 patent, the skin 134 is provided with anti-flex covers 146 which are bonded to the side panels 138 on either side so as to form envelopes. A multi-chambered anti-flex air bladder 148 resides in each of the envelopes formed by the anti-flex covers 146, and the anti-flex air bladders 148 are inflated to provide means for tensioning the skin 134. The combination of the anti-flex covers 146 and the anti-flex air bladders 148 is also intended to provide greater rigidity to the collapsible canoe 100. Since the anti-flex covers 146 must be bonded to the side panels 138 in order to anchor the anti-flex air bladders 148 to the skin 134, fabrication of the skin 134 is complicated and more expensive.

The frame 102 of the collapsible canoe 100 of the '634 patent is intended to be a free-standing, isotropically secure structure, which is achieved through the securing of the elements of the frame 102 together. While the frame 102 of the '634 patent may provide enhanced rigidity and structural integrity which is independent of the skin 134, such is of limited value, since the skin 134 must always be part of the collapsible canoe 100, and securing of the frame elements can be achieved through interaction between the skin 134 and the frame 102. Failure of the skin 134 will still make the collapsible canoe 100 unseaworthy. The difficulty and cost of fabrication of the collapsible canoe 100 is increased by the large number of connectors which are required to secure the frame elements together. Additionally, the large number of connectors greatly complicates assembly and disassembly of the collapsible canoe 100. Furthermore, the connectors are typically affixed to the frame members with rivets or pins, and the large number of holes required to accommodate multiple connectors being so attached significantly weakens the structural elements of the frame 102.

In addition to the disadvantages set forth above, the collapsible canoe 100 may still be liable to failure of the gunwale sleeves 136. While the frame 102 is intended to be free-standing and somewhat rigid, the '634 patent teaches that the rigidity of the collapsible canoe 100 may be adjusted by varying the pressure in the anti-flex air bladders 148, indicating that there is still a significant amount of flexibility in the frame 102. This flexibility may tend to cause upwards forces $F_2$ on the stem elements 118, which again are transmitted to the gunwale sleeves 136 in the manner discussed above with regard to the collapsible canoe 50, and again may result in failure of the gunwale sleeves 136.

Thus, there is a need for a collapsible canoe which provides ease of fabrication, assembly, and disassembly, which overcomes the problems of failure of the gunwale sleeves due to upwards forces of the stem elements.

SUMMARY OF THE INVENTION

The present invention is a collapsible canoe which overcomes the problems discussed above. The collapsible canoe shares many features in common with prior art collapsible canoes, and has a frame which includes a pair of gunwales, each having a bow end and a stem end. A pair of gunwale terminators connect the bow ends and the stem ends of each of the gunwales. At least one thwart is connected to the gunwales to maintain a separation therebetween. The frame also includes a series of ribs, each supported against the gunwales by gunwale-engaging clips. A keel stringer and supplemental bottom stringers traverse the ribs. A pair of stem elements are attached to and terminate the keel stringer, each being configured such that, when attached to the keel stringer, a stem end region of the stem element resides in close proximity to one of the gunwale terminators. The supplemental bottom stringers terminate at each end in a bottom stringer terminator which is affixed to one of the stem elements.

The collapsible canoe has a skin which covers the frame and is supported thereon. The skin has a pair of gunwale sleeves which engage the gunwales of the frame to secure the skin to the frame. The skin also has a pair of side panels which attach to the gunwale sleeves or may be formed integrally therewith, and a bottom panel which is attached to the side panels. Preferably, the bottom panel is provided with a bottom foam lining to minimize abrasion of the bottom panel. A pair of terminator panels connect the side panels to each other and to the bottom panel at each end of the collapsible canoe.

Means for tensioning the skin are provided. In one embodiment, the means for tensioning the skin are provided by a pair of inflatable compartments which are similar to those discussed above with respect to the prior art collapsible canoes (10 and 50). Again, it is preferred to provide an inflatable compartment support rod on either side of the collapsible canoe to provide longitudinal support for the inflatable compartments.

In another embodiment, the means for tensioning the skin are provided by sizing the ribs and the skin such that the ribs tension the skin as they are installed by being pivoted to a vertical position. In this embodiment, side stringers are employed which are engaged by stringer-engaging clips attached to the ribs. Preferably, the side panels are provided with a side foam lining to minimize abrasion of the side panels.

Means for stabilizing the stem elements with respect to the gunwale terminators are also provided. The means for stabilizing the stem elements attach to the stem elements of the frame and to the terminator panels of the skin to prevent upward movement of the stem end regions with respect to the terminator panels. This stabilizes the stem elements with respect to the gunwale terminators, since the gunwale terminators are stabilized with respect to the terminator panels by their engagement with the gunwale sleeves. Since upward motion of the stem end regions relative to the terminator panels is prevented, any upward force $F_2$ of the stem elements will be transferred to the terminator panels of the skin, rather than being accommodated by the gunwale terminators which stresses the gunwale sleeves. The terminator panels are typically constructed sufficiently strong as to be able to readily accommodate such upward forces.

In one preferred embodiment, the means for stabilizing the stem elements is provided by a pair of prongs, each of which is affixed to one of the pair of stem elements. Preferably, the prong is attached to the stem element at the stem end region. A slot is provided in each of the terminator panels, positioned to engage one of the prongs. Engagement between the prong and the slot stabilizes the prong by preventing upward movement of the prong relative to the slot, thereby stabilizing the stem elements with respect to the gunwale terminators.

In another preferred embodiment, the means for stabilizing the stem elements is provided by a pair of straps attached to the pair of terminator panels, in combination with means for fastening the pair of straps to the pair of stem elements. The strap passes over the gunwale terminator and the stem end region of the frame and is tightly secured with respect to the stem element such that the strap prevents upward motion of the stem end region with respect to the terminator panel, thereby stabilizing the stem elements with respect to the gunwale terminators.

Preferably, the means for fastening the pair of straps to the pair of stem elements are provided by anchoring means affixed to each of the stem elements in combination with means for adjustably engaging the straps with the anchoring means. Means for adjustably engaging the straps allow adjustability to accommodate slight manufacturing variations in the skin.

Because upward forces $F_2$ of the stem elements are transferred to the terminator panels of the skin, there is no requirement to connect the gunwale terminator to the stem elements. However, it is preferred for the stem elements to each be provided with a gunwale terminator cradle which is configured to supportably engage one of the gunwale terminators to prevent upward movement of the stem end region relative to the gunwale terminator. Such engagement of the stem element with the gunwale terminator allows stresses due to upward forces $F_2$ of the stem element to be shared by the terminator panel and the gunwale sleeves. This minimizes the stresses on either element, and provides an extra degree of safety through redundancy. In the case of failure of the terminator panel, the stem element will be maintained in position temporarily by the gunwale sleeves, gunwales, and gunwale terminator until the collapsible canoe can be brought back to land and repaired.

BEST MODE FOR CARRYING THE INTO PRACTICE

Figure 1:
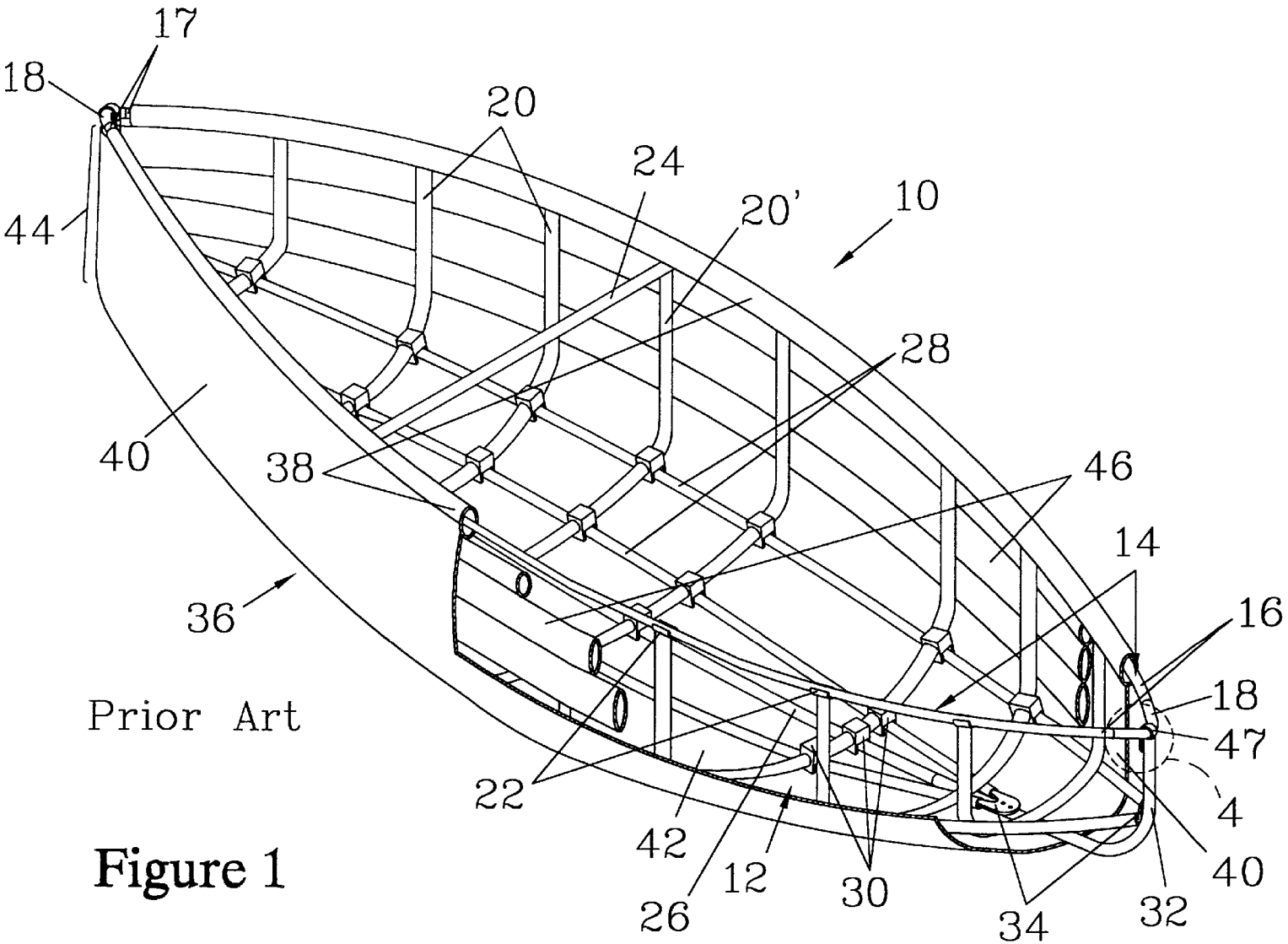
Prior Art Figure 1
FIG. 1 is an isometric view illustrating a prior art collapsible canoe having a frame covered by a skin. The frame has a pair of gunwales connected together by gunwale terminators. The frame also has stem elements, each secured to one of the gunwale terminators by a gunwale terminator securing strap.
Figure 2:
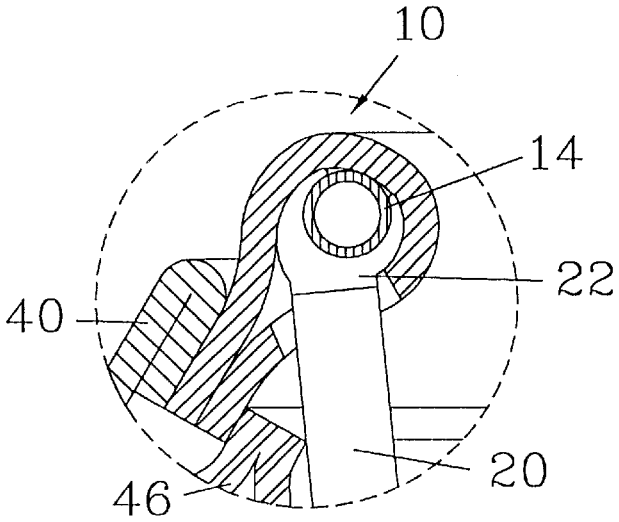
Prior Art Figure 2
FIG. 2 is a detail view of the frame of the collapsible canoe shown in FIG. 1, showing the connection of a rib to one of the gunwales. A gunwale-engaging clip supports the rib against the gunwale, and the gunwale and the rib are secured together by tension of the skin.
Figure 3:
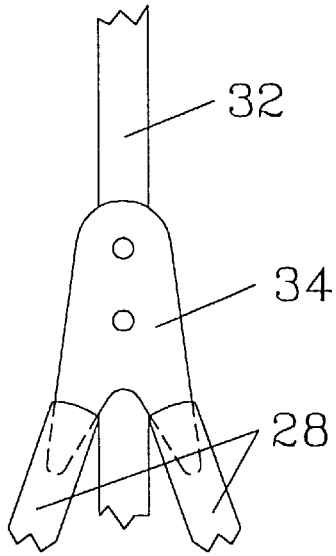
Prior Art Figure 3
FIG. 3 is a detail view of a bottom stringer terminator employed in the collapsible canoe illustrated in FIGS. 1 and 2.
Figure 4:
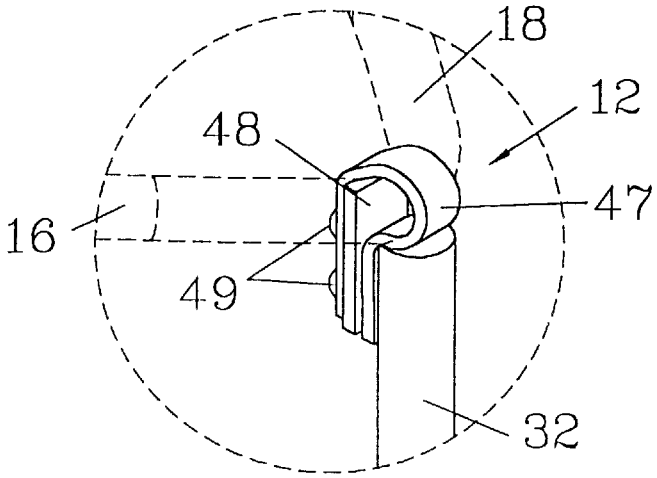
Prior Art Figure 4
FIG. 4 is an enlarged view of the region 4 of FIG. 1, showing details of the connection of one of the stem elements to one of the gunwale terminators.
Figure 5:
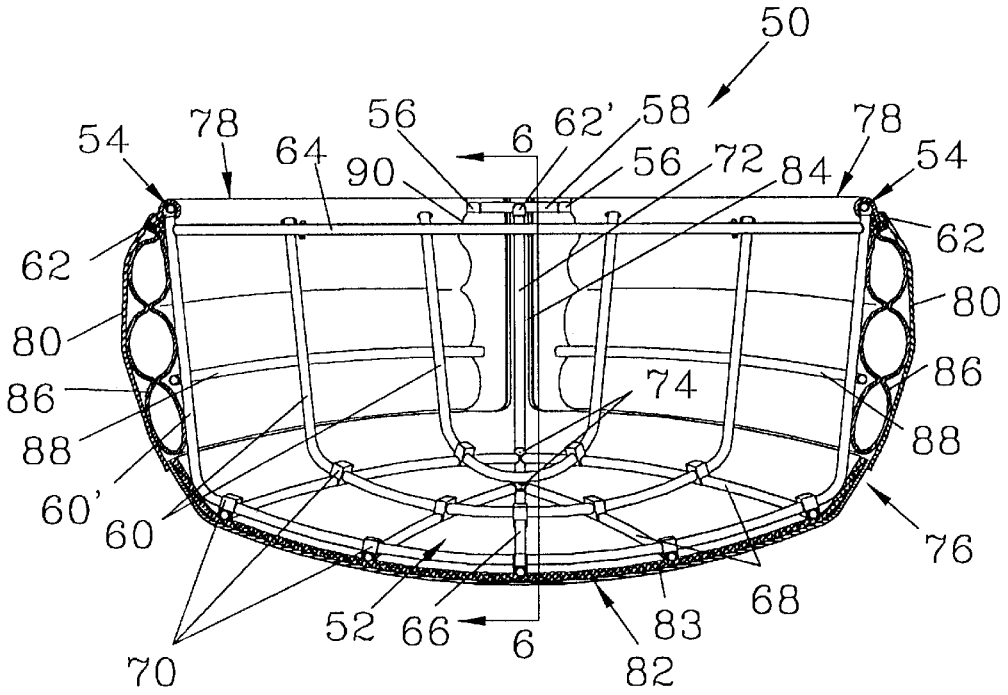
Prior Art Figure 5
FIG. 5 is a section view showing one end of another prior art collapsible canoe which is similar to the collapsible canoe shown in FIGS. 1 through 4. In this collapsible canoe the frame has a stem element which engages the gunwale terminator but is not secured thereto. The collapsible canoe also employs a skin having terminator panels at the ends and employs inflatable compartment support rods to improve the appearance of the collapsible canoe.
Figure 6:
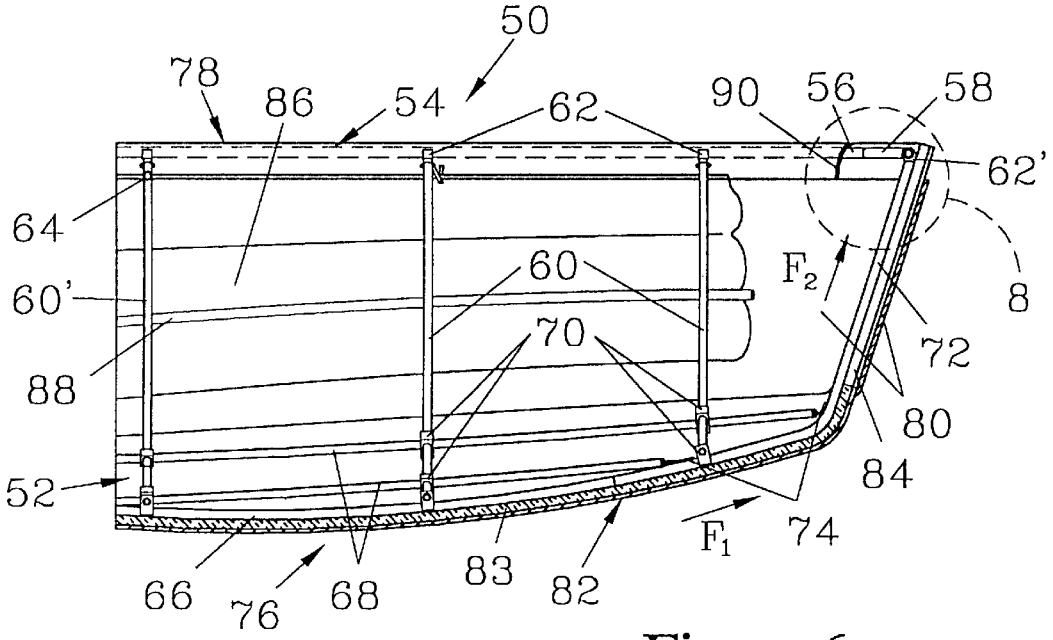
Prior Art Figure 6
FIG. 6 is a view of section 6—6 of FIG. 5, showing forces on the stem element which can cause failure of gunwale sleeves of the skin which engage the gunwales of the frame.
Figure 7:
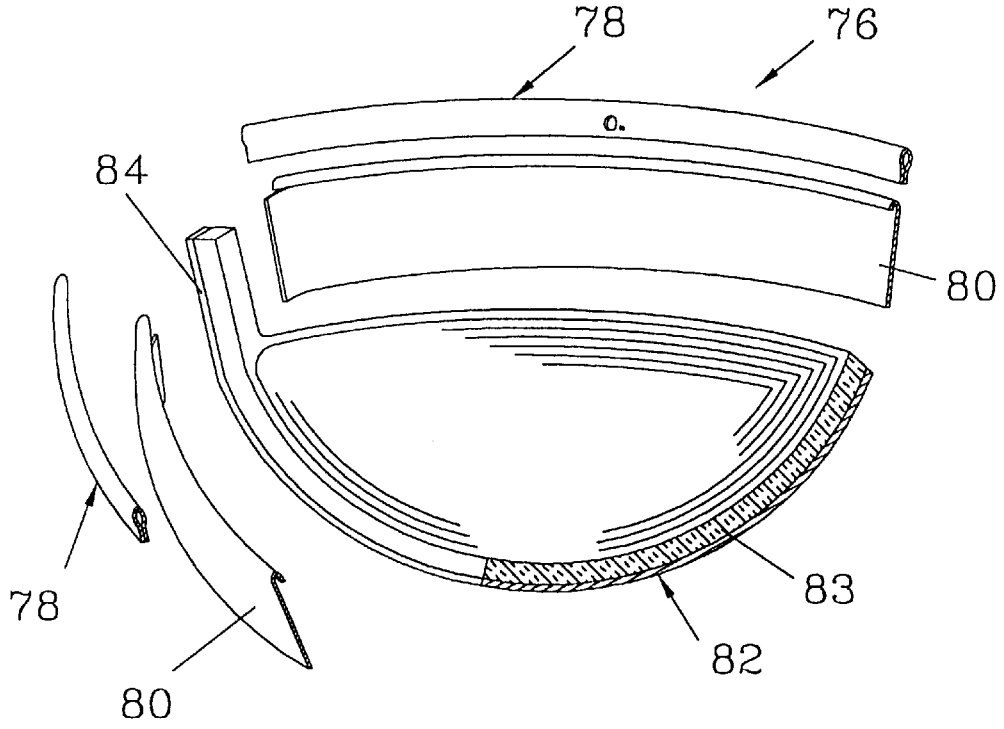
Prior Art Figure 7
FIG. 7 is an exploded view of the portion of the skin at the bow end of the collapsible canoe illustrated FIG. 5. The terminator panel in this embodiment is provided by an extension of the bottom panel.
Figure 8:
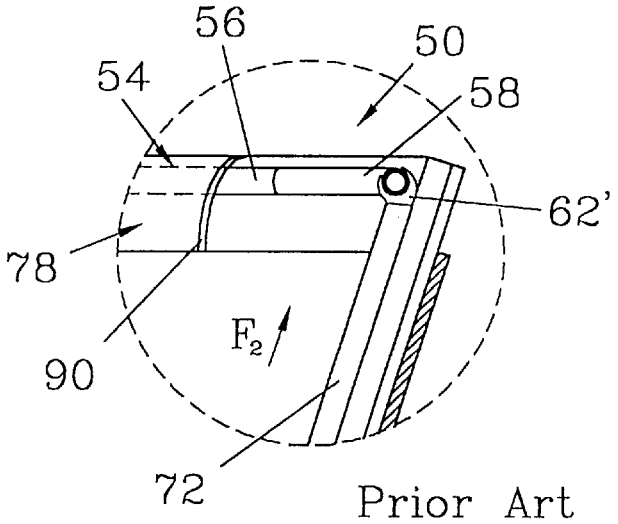
Prior Art Figure 8
FIG. 8 is detail view of the region 8 of FIG. 6, showing additional details of the stem and the gunwale terminator.
Figure 9:
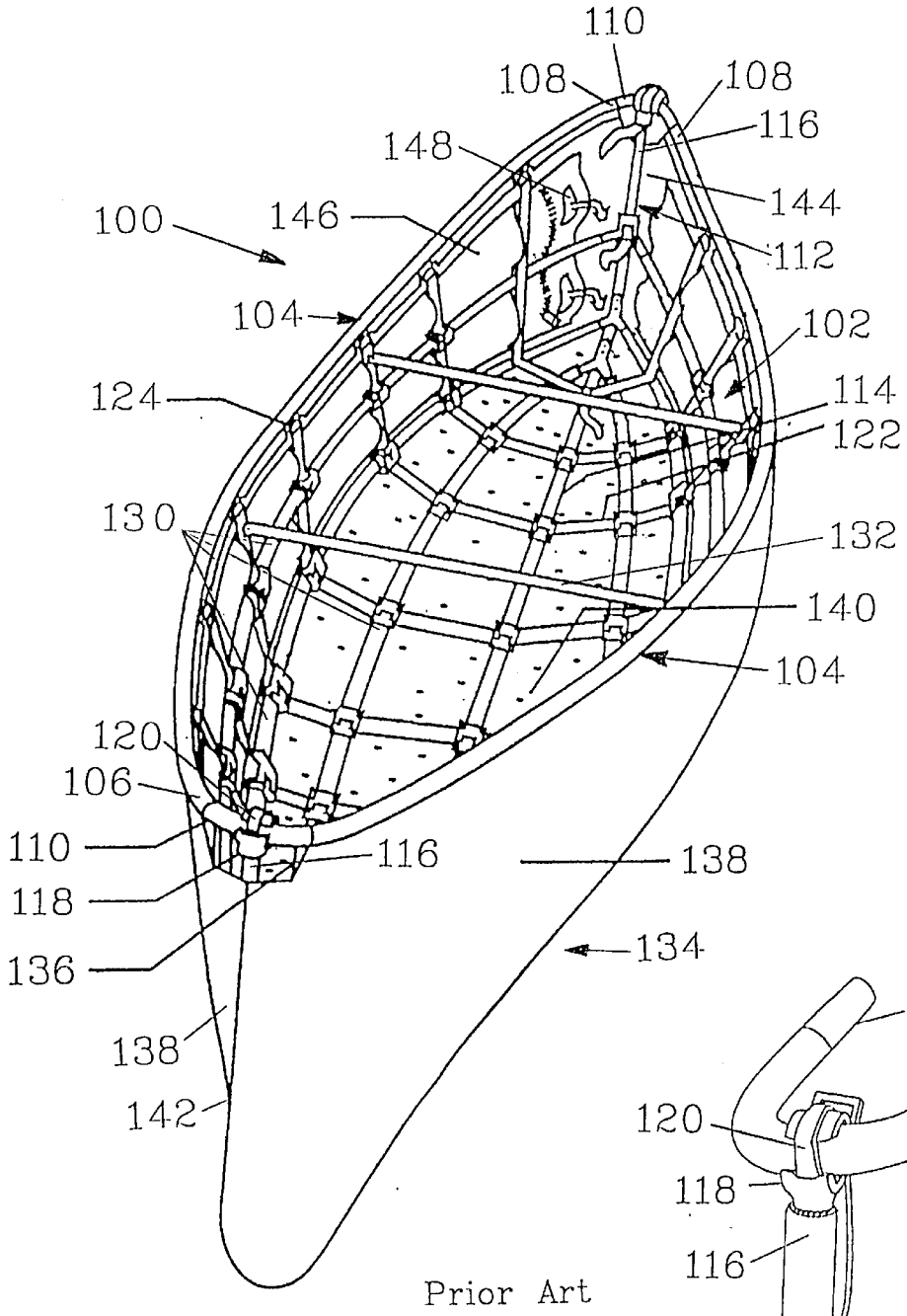
FIG. 9 is a perspective view of another prior art collapsible canoe, which has a free-standing, standing, isotropically secure frame covered by a skin.
Figure 10:
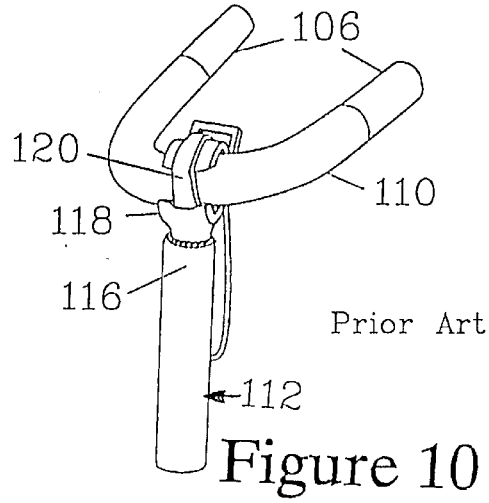
FIG. 10 is a detail view of a portion of the frame of the prior art collapsible canoe shown in FIG. 9, showing the connection of a stem element to a gunwale terminator. The stem element is secured to the gunwale terminator by a gunwale fastener and a securing strap to provide an isotropically secure connection.
Figure 11:
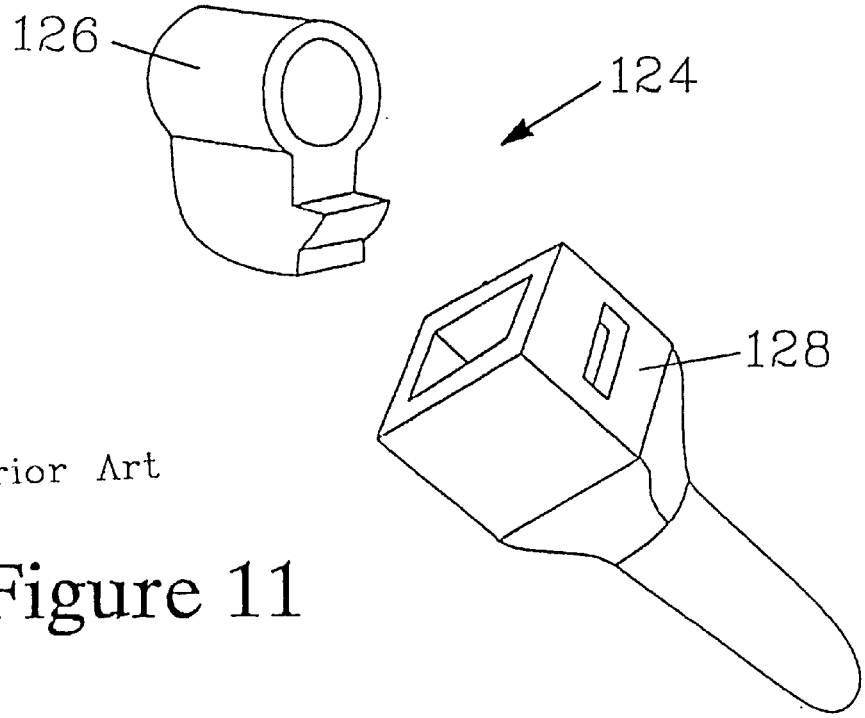
Prior Art Figure 11
FIG. 11 is a detail view showing male and female parts of a rib-gunwale lockconnector which is employed in the collapsible canoe shown in FIG. 9 to secure the ribs to the gunwales. The male female parts are shown prior to being locked together.
Figure 12:
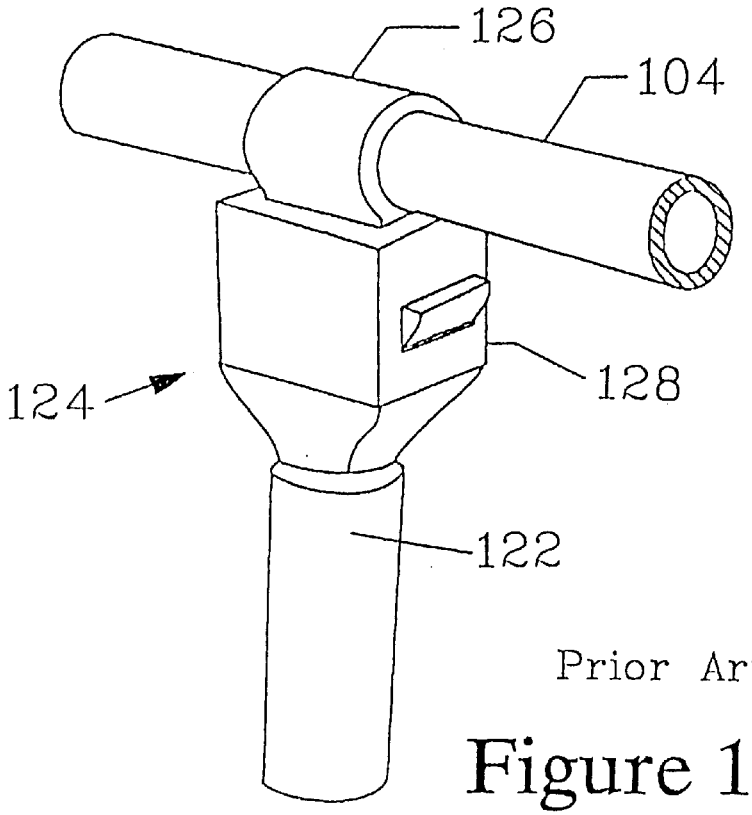
Prior Art Figure 12
FIG. 12 is a detail view showing the male and female parts of the rib-gunwale lockconnector shown in FIG. 11 after they have been locked together.
Figure 13:
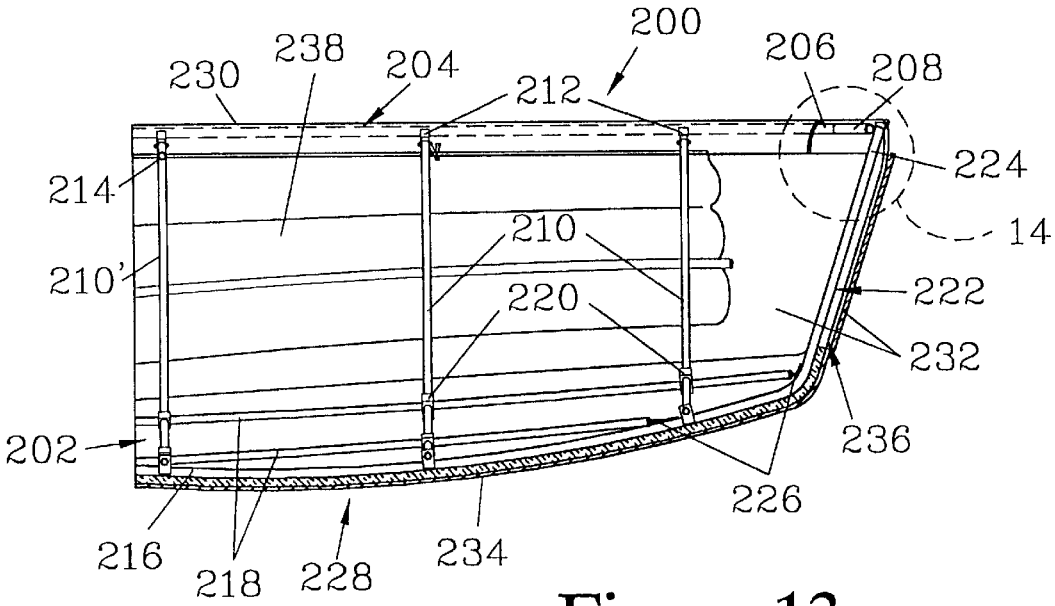
FIG. 13 is a section view of one embodiment of the present invention, which corresponds to the view shown in FIG. 6. In this embodiment, the stem element is provided with a prong which engages a slot in a terminator panel of the skin. The slot is positioned to stabilize the prong, thereby stabilizing the stem element with respect to the gunwale terminator. Inflatable compartments are provided for tensioning the skin.

FIG. 13 is a section view showing one end of a collapsible canoe 200 forming one embodiment of the present invention, the view corresponding to the view shown in FIG. 6. It should be appreciated that the other end of the collapsible canoe 200 is similar to the end shown. The collapsible canoe 200 shares many features in common with the prior art collapsible canoe 50 discussed above. The collapsible canoe 200 has a frame 202 which includes a pair of gunwales 204 (only one of which is shown), each having a bow end 206 and a stern end (not shown). A gunwale terminator 208 connects the bow ends 206 of the gunwales 204 together. Similarly, although not shown, another gunwale terminator 208 connects the stern ends of the gunwales 204 together. A series of ribs 210 are attached to the gunwales 204 by gunwale-engaging clips 212. A thwart 214 is connected to the gunwales 204 to maintain a separation between the gunwales 204. Again, in the embodiment shown, the thwart 214 is attached to the rib 210'.

A keel stringer 216 traverses the ribs 210 and is centrally positioned with respect to the gunwales 204. The frame 202 also has supplemental bottom stringers 218 which traverse the ribs 210. Again, the ribs 210 are provided with stringer-engaging clips 220 to maintain the keel stringer 216 and the supplemental bottom stringers 218 in position. A stem element 222 terminates the keel stringer 216, and extends up to a stem end region 224 which resides near the gunwale terminator 208. The supplemental bottom stringers 218 terminate at bottom stringer terminators 226 which are attached to the stem element 222.

The collapsible canoe 200 has a skin 228 having a pair of gunwale sleeves 230 (only one of which is shown) which engage the gunwales 204 of the frame 202. A pair of side panels 232 (one of which is only partially shown) attach to the gunwale sleeves 230. A bottom panel 234 is attached to the side panels 232, and a terminator panel 236 connects the side panels 232 to each other and to the bottom panel 234.

Means for tensioning the skin are provided by a pair of inflatable compartments 238 (one of which is shown) which are similar to the inflatable compartments 86 discussed above.

Means for stabilizing the stem element 222 with respect to the gunwale terminator 208 are provided in the collapsible canoe 200. As shown in the detail view of FIG. 14, the means for stabilizing the stem element 222 are provided by a prong 240, which is affixed to the stem end region 224 of the stem element 222, and a slot 242 in the terminator panel 236. The slot 242 is positioned to engage the prong 240. When the prong 240 and the slot 242 are so engaged, upward movement of the prong 240 relative to the slot 242 is prevented, thereby stabilizing the prong 240 with respect to the slot 242. This stabilization of the prong 240 stabilizes the stem element 222 to which it is attached with respect to the terminator panel 236, thereby stabilizing the stem element 222 with respect to the gunwale terminator 208, which is itself stabilized with respect to the terminator panel 236 by the engagement of the gunwales 204 with the gunwale sleeves 230 and the tension in the skin 228. Any upward force $F_2$ of the stem element 222 is transferred to the terminator panel 236 by the engagement of the prong 240 with the slot 242.

It should be noted that, in the collapsible canoe 200, the gunwale terminator 208 is not directly connected to the stem element 222. Such direct connection is not necessary, since upward forces $F_2$ of the stem element 222 are accommodated by the terminator panel 236, rather than by the gunwale terminator 208. Such an arrangement avoids stresses on the gunwale sleeves 230, but failure of the terminator panel 236 may result in a loss of structural integrity of the collapsible canoe 200. The construction of the terminator panel 236 is typically sufficiently strong as to avoid being prone to failure, but an arrangement where failure of the terminator panel 236 can be accommodated may be desirable for use in extreme conditions, such as uses where the terminator panel 236 is exposed to severe abrasion.

Figure 14:
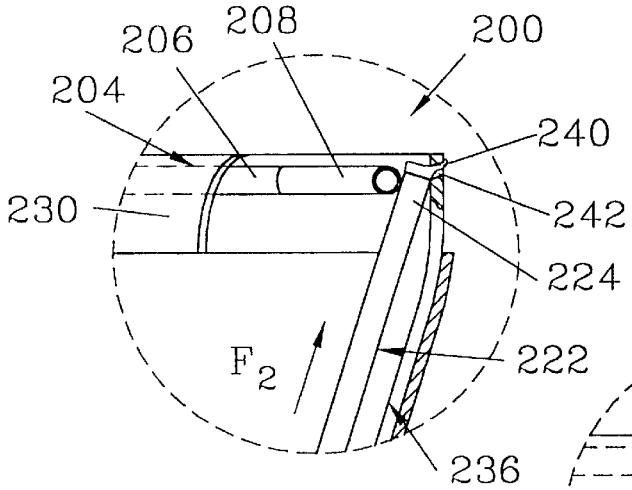
FIG. 14 is a detailed view of the region 14 of FIG. 13, showing details of the prong and the slot.
Figure 15:
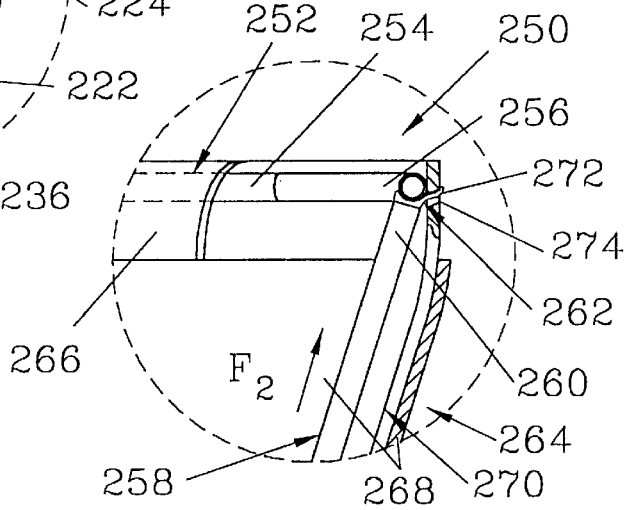
FIG. 15 is a view which corresponds to the view of FIG. 14, showing details of another embodiment of the present invention. In this embodiment, the stem element is provided with both a gunwale terminator cradle for supporting the gunwale terminator and a prong which engages a slot in the terminator panel.

FIG. 15 is a view which corresponds to the view of FIG. 14, illustrating a portion of a collapsible canoe 250 which provides redundancy in accommodating upward forces. The collapsible canoe 250 again has a pair of gunwales 252 (only one of which is shown), each having a bow end 254 connected to a gunwale terminator 256. A stem element 258 extends up to a stem end region 260 near the gunwale terminator 256. A gunwale terminator cradle 262 is provided on the stem end region 260. The gunwale terminator cradle supportably engages the gunwale terminator 256 to prevent upward motion of the stem element 258 with respect to the gunwale terminator 256.

The collapsible canoe 250 has a skin 264 having a pair of gunwale sleeves 266 (only one of which is shown) attached to a pair of side panels 268, which in turn are connected together by a terminator panel 270.

Means for stabilizing the stem element 258 with respect to the gunwale terminator 256 are provided by a prong 272, which in this embodiment is affixed to the gunwale terminator cradle 262, and a slot 274 in the terminator panel 270 which is positioned to engage the prong 272. The engagement of the stem element 258 with the gunwale terminator 256 and the prong 272 with the slot 274 allows stresses due to upward forces $F_2$ of the stem element 258 to be shared by the terminator panel 270 and the gunwale sleeves 266. This minimizes the stresses on either element, and provides an extra degree of safety through redundancy. If the terminator panel 270 fails, the stem element 258 is maintained in position by the gunwale sleeves 266, the gunwales 252, and the gunwale terminator 256 until the terminator panel 270 can be repaired.

Figure 16:
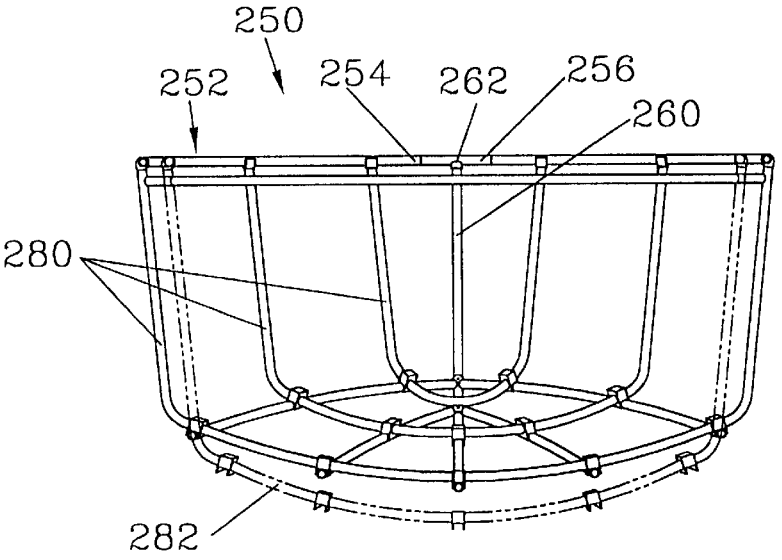
FIG. 16 is a partial view of the embodiment shown in FIG. 15. This embodiment employs auxiliary ribs which may optionally replace a selected subset of the ribs in order to change the handling characteristics of the collapsible canoe.

FIG. 16 is a view of one end of the frame elements of the collapsible canoe 250. The collapsible canoe 250 differs further from the collapsible canoe 200 in that the collapsible canoe 250 has both a series of ribs 280, and a set of auxiliary ribs 282, one of which is shown in phantom in FIG. 16. The set of auxiliary ribs 282 correspond to a subset of the ribs 280, and may be substituted for the corresponding ribs 280 to alter the shape of the collapsible canoe 250.

Figure 17:
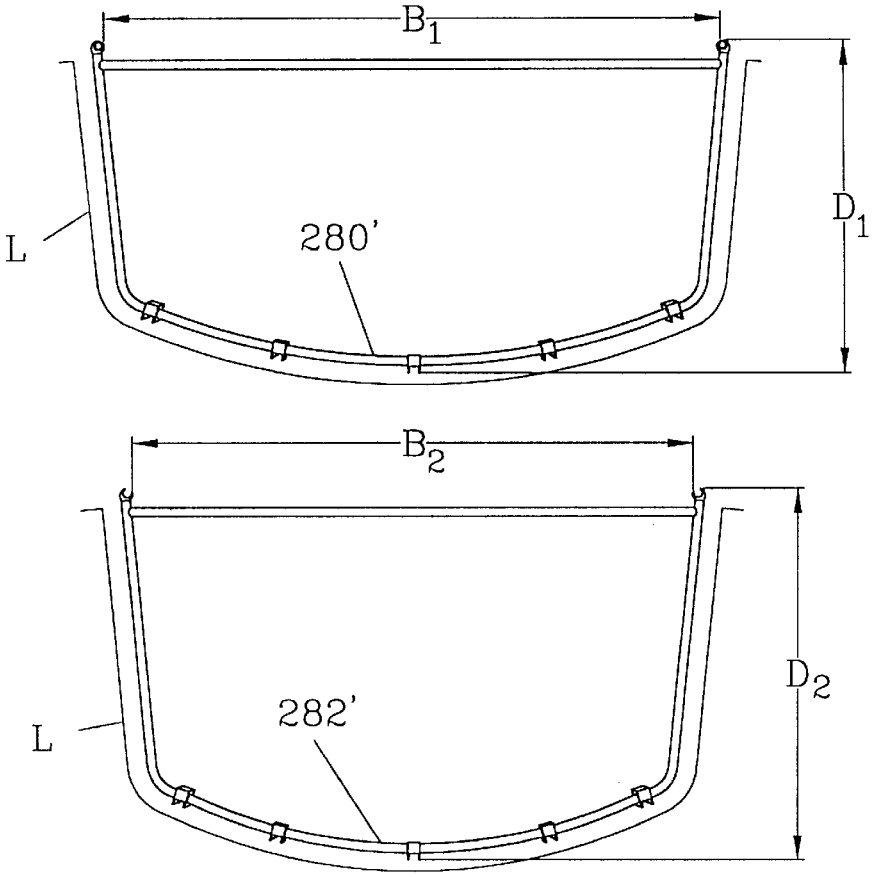
FIG. 17 is a view of one of the ribs of the collapsible canoe shown in FIGS. 15 and 16, along with a corresponding one of the auxiliary ribs.

FIG. 17 compares a rib 280' with its corresponding auxiliary rib 282'. To assure that the skin 264 remains correctly fitted to the ribs 280 and auxiliary ribs 282 of the collapsible canoe 250, it is necessary for the rib 280' and the rib 282' to both have a common rib length L. However, while the rib length L of both the rib 280' and the auxiliary rib 282' is the same, the rib 280' defines a first beam $B_1$ and a first depth $D_1$, while the auxiliary rib 282' defines a second beam $B_2$ and a second depth $D_2$ which are respectively different from the first beam $B_1$ and the first depth $D_1$.

Since the handling characteristics of the collapsible canoe 250 are largely dependent on the beam and depth, altering these dimensions alters the handling characteristics of the collapsible canoe 250. In the example illustrated, the first beam $B_1$ is greater than the second beam $B_2$, and the first depth $D_1$ is less than the second depth $D_2$. These relative dimensions make the collapsible canoe 250 broader and more stable when the ribs 280 are exclusively employed, and narrower and faster when the selected subset of the ribs 280 have been replaced by auxiliary ribs 282. For use with inexperienced canoeists, exclusive use of the ribs 280 provides a stable configuration of the collapsible canoe 250 which is less liable to capsizing. For more skilled canoeists, who may demand greater performance, use of the auxiliary ribs 282 in place of the corresponding ribs 280 provides a configuration of the collapsible canoe 250 which offers greater speed with less stability. It has been found practical for the first beam $B_1$ to be up to about three inches greater than the second beam $B_2$, and the first depth $D_1$ to be up to about 1½ inches less than the second depth $D_2$. These changes in the relative dimensions provide a significant change in handling characteristics while maintaining the fit of the skin 264.

It should be noted that, as indicated in FIG. 16, it is not necessary to replace all of the ribs 280 with auxiliary ribs 282. Typically, only the ribs 280 which reside in the central regions of the collapsible canoe 250 will be replaced with auxiliary ribs 282. It has been found that in a fourteen foot model of the collapsible canoe 250 having eight ribs 280, only the four central ribs 280 need be replaced with auxiliary ribs 282 to alter the handling characteristics. Similarly, in a fifteen foot model having nine ribs 280, only the central five ribs 280 need be replaced with auxiliary ribs 282. Thus, the auxiliary ribs 282 allow a user to effectively have two different collapsible canoes 250, with different handling characteristics, with little more weight or storage space requirements than a single collapsible canoe 250, since only a small number of auxiliary ribs 282 are added.

Figure 18:
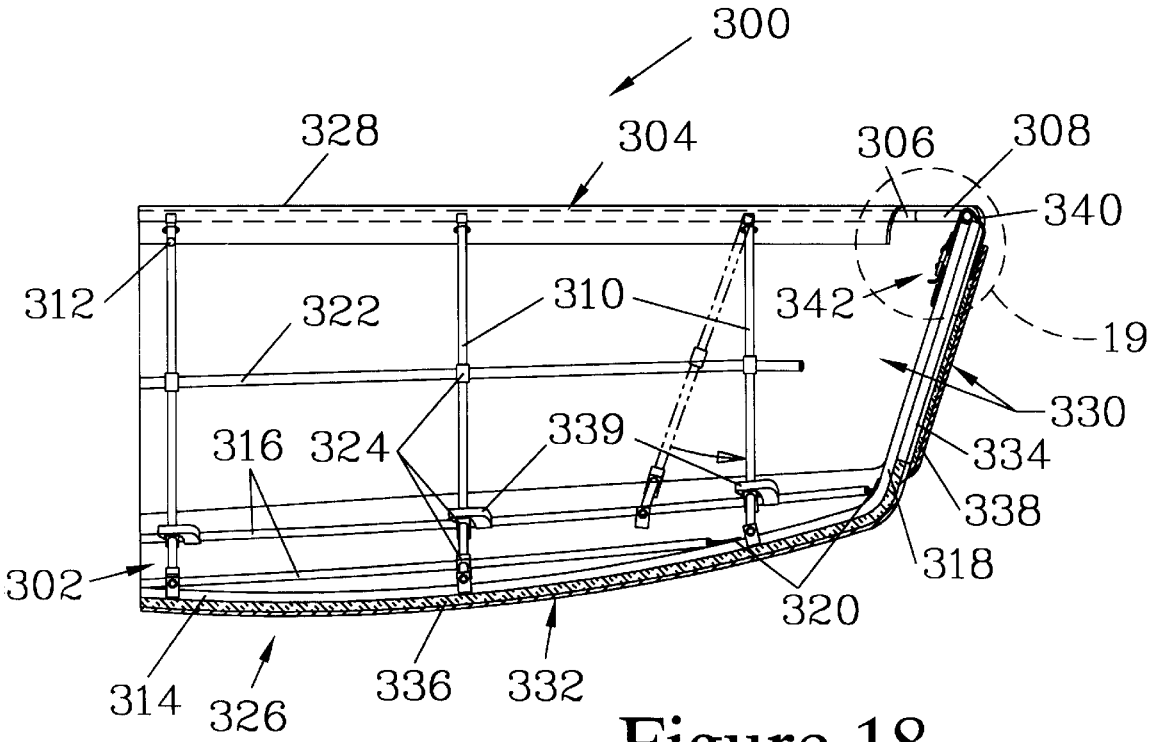
FIG. 18 is a section view of another embodiment of the present invention. In this embodiment, a strap is attached to the terminator panel, and means for fastening the strap to the stem element are provided. This embodiment also employs ribs which are sized to provide means for tension as they are installed.
Figure 19:
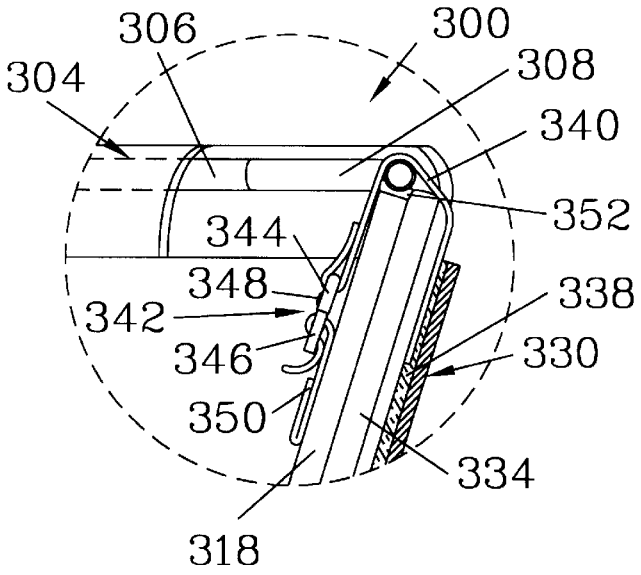
FIG. 19 is a detailed view of the region 19 of FIG. 18, showing details of the strap and the stem element. A detaching buckle connected to an anchor strap provides means for fastening the strap respect to the stem element.

FIGS. 18 and 19 illustrate another embodiment of the present invention, a collapsible canoe 300, and correspond respectively to the views of FIGS. 13 and 14. The collapsible canoe 300 again has a frame 302 having a pair of gunwales 304 (one of which is shown), each having a bow end 306 and a stern end (not shown). A gunwale terminator 308 connects the bow ends 306 and the stem ends of each of the gunwales 304 together. The frame 302 also has a series of ribs 310 and athwart 312.

A keel stringer 314 and supplemental bottom stringers 316 traverse the ribs 310. A stem element 318 terminates the keel stringer 314. The supplemental bottom stringers 316 terminate at bottom stringer terminators 320. Side stringers 322 (only one of which is shown) are provided, which also traverse the ribs 310. Stringer engaging clips 324 on the ribs 310 engage the keel stringer 314, the supplemental bottom stringers 316, and the side stringers 322 to maintain them in position relative to the ribs 310.

The collapsible canoe 300 has a skin 326 having a pair of gunwale sleeves 328 (one of which is shown), a pair of side panels 330 (one of which is only partially shown), a bottom panel 332, and a terminator panel 334. Preferably, the bottom panel 332 is provided with a bottom foam lining 336, while the side panels 330 are each provided with a side foam lining 338 to minimize abrasion of the skin 326.

Means for tensioning the skin 326 are provided by the ribs 310. When installed, the ribs 310 are each engaged with the gunwales 304 at an angle, as indicated in phantom. Typically the side stringer 322 is positioned to engage the stringer-engaging clips 324 on the rib 310 at this point. The rib 310 is then pivoted to a vertical position, gradually increasing the tension of the skin 326 as the rib 310 approaches the vertical position. Locking clips 339 are preferably mounted to a subset of the supplemental bottom stringers 316. Such locking clips 339 are known in the art, and engage the corresponding stringer-engaging clips 324 on each rib 310 to maintain each rib 310 in its vertical position.

It should be noted that the ribs 310 must be carefully sized relative to the skin 326 in order to provide the means for tensioning the skin 326. Optionally, an alternate set of ribs could be employed which are smaller in size than the ribs 310, and inflatable compartments (not shown) could be employed to provide the means for tensioning the skin 326. The option of using two or more separate sets of different sized ribs allows modifying the shape and handling characteristics of the collapsible canoe 300.

Means for stabilizing the stem element 318 with respect to the gunwale terminator 308 are provided. In the collapsible canoe 300, the means for stabilizing the stem element 318 are provided by a strap 340 attached to the terminator panel 334 in combination with means for fastening the strap 340 to the stem element 318. In the embodiment illustrated, the means for fastening the strap 340 include anchoring means affixed to the stem element 318 in combination with means for adjustably engaging the strap 340 with the anchoring means.

The anchoring means are provided by an anchor strap 342 which is attached to the stem element 318. The means for adjustably engaging the strap 340 with the anchor strap 342 are provided by a detaching buckle 344.

The detaching buckle 344 has a buckle female part 346 and a buckle male part 348, which are detachably engaged with each other. Such detaching buckles are known in the art, and it is preferred for the detaching buckle 344 to have an activating button 350 for causing detachment of the buckle female part 346 from the buckle male part 348. The buckle female part 346 is attached to the strap 340, while the buckle male part 348 is adjustably engaged by an anchor strap 342. The strap 340 passes over the gunwale terminator 308, and the buckle female part 346 and buckle male part 348 are engaged with each other. The anchor strap 342 is threaded through the buckle male part 348 and adjusted with respect to the buckle male part 348 to tightly secure the strap 340 and the buckle female part 346 with respect to the stem element 318. Once the position of the anchor strap 342 with respect to the buckle male part 348 is adjusted, the buckle female part 346 and the buckle male part 348 may be readily attached or detached from each other without further adjustment, facilitating assembly and disassembly of the collapsible canoe 300.

The fastening of the strap 340 to the stem element 318 prevents upward motion of the stem element 318 with respect to the terminator panel 334, thereby stabilizing the stem element 318 with respect to the gunwale terminator 308. Preferably, the stem element 318 is provided with a gunwale terminator cradle 352 for engaging the gunwale terminator 308.

Figure 20:
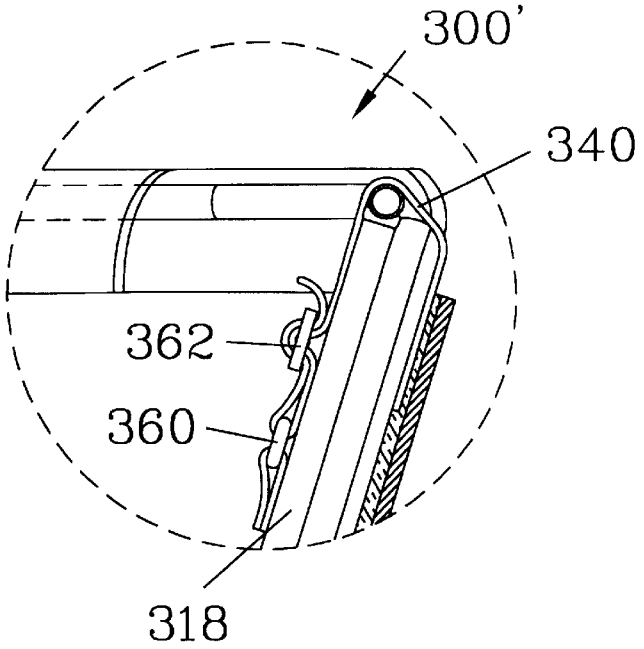
FIG. 20 is a view of an alternative embodiment to that shown in FIG. 19. In this embodiment, a D-ring attached to the stem element provides anchoring means, while a ladderlock lock buckle provides means for adjustably engaging the strap with the D-ring.

FIG. 20 is a view which corresponds to the view of FIG. 19, illustrating a portion of a collapsible canoe 300' which employs an alternative means for securing the strap 340. In this embodiment, the means for fastening the strap 340 again include anchoring means affixed to the stem element 318 combined with means for adjustably engaging the strap 340 with the anchoring means.

The anchoring means in this embodiment are provided by a D-ring 360 which is attached to the stem element 318. The means for adjustably engaging the strap 340 with the D-ring 360 are provided by a ladder-lock buckle 362 which is adjustably engaged by the strap 340.

To fasten the strap 340 with respect to the stem element 318, the strap 340 is threaded through the ladder-lock buckle 362, passed through the D-ring 360, and then rethreaded through the ladder-lock buckle 362. The ladder-lock buckle 362 is configured to taughtly engage the strap 340 when it is so threaded, in the manner which is well known in the art.

Figure 21:
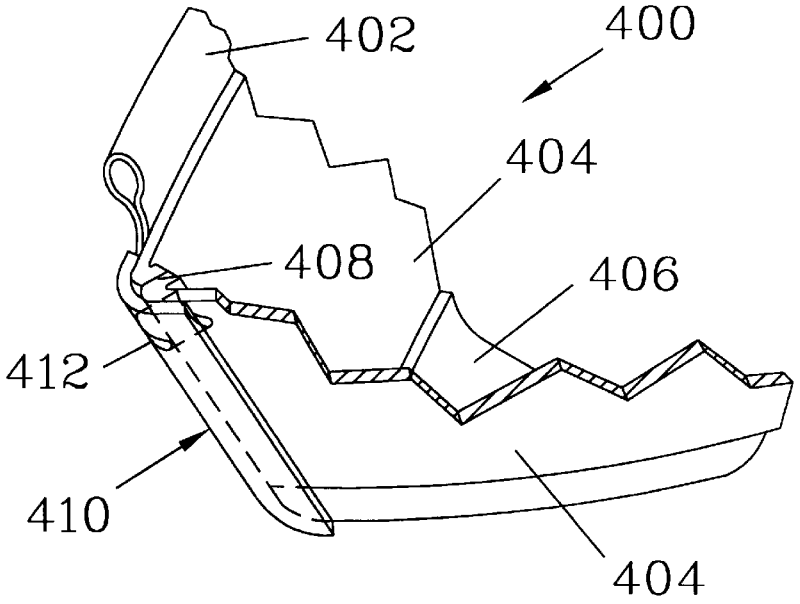
FIG. 21 is a view of a portion of a skin which may be employed as an alternative to the skins shown in FIGS. 13 through 15. In this embodiment, the side panels are attached to each other and to the bottom panel at an end seam. A heat sealable tape is applied over the end seam to provide a terminator panel. A slot is provided in the terminator panel and in the end seam, for engaging a prong such as is shown in FIGS. 14 and 15.

FIG. 21 is a view of a portion of a skin 400 which may be employed as an alternative to the skins (228, 264) shown in FIGS. 13 through 15. The skin 400 has a pair of gunwale sleeves 402 (only one of which is shown), a pair of side panels 404 attached to the gunwale sleeves 402, and a bottom panel 406 which is attached to the side panels 404.

In the skin 400, the side panels 404 are attached to each other and to the bottom panel 406 at an end seam 408. A terminator panel 410 is provided by a heat sealable tape applied over the end seam 408, and serves to secure the side panels 404 to each other and to the bottom panel 406.

A slot 412 is provided in the terminator panel 410, and also extends through the end seam 408. The slot 412 is positioned for engaging a prong such as the prongs (240, 272) shown in FIGS. 14 and 15.

While the novel features of the present invention have been described in terms of particular embodiments and preferred applications, it should be appreciated by one skilled in the art that substitution of materials and modification of details obviously can be made without departing from the spirit of the invention.

What I claim is:

1. A collapsible canoe comprising:

a pair of gunwales, each having a bow end and a stern end;

a pair of gunwale terminators which are configured to engage said bow ends and said stern ends;

a series of ribs connected to said pair of gunwales by gunwale-engaging clips;

at least one thwart which engages said pair of gunwales to maintain a separation therebetween;

a keel stringer which traverses said series of ribs;

supplemental bottom stringers which traverse said series of ribs;

a pair of stem elements which attach to said keel stringer and extend to said pair of gunwale terminators;

bottom stringer terminators which are affixed to said pair of stem elements and which engage said supplemental bottom stringers;

a skin having, a pair of gunwale sleeves, each of which slidably engages one of said pair of gunwales, a pair of side panels which attach to said pair of gunwale sleeves, a bottom panel attached to said pair of side panels, and a pair of terminator panels which secure said pair of side panels with respect to each other and said bottom panel;

means for tensioning said skin; and means for stabilizing said pair of stem elements with respect to said pair of gunwale terminators, which attach to said pair of stem elements and to said pair of terminator panels.

2. The collapsible canoe of claim 1 wherein said pair of terminator panels are provided by extensions of said bottom panel, to which said pair of side panels are attached.

3. The collapsible canoe of claim 1 wherein said means for tensioning said skin comprises:

inflatable compartments positioned between said pair of side panels and said series of ribs.

4. The collapsible canoe of claim 3 wherein said means for tensioning said skin further comprises:

a pair of inflatable compartment support rods which slidably engage said series of ribs and reside between said supplemental bottom stringers and said pair of gunwales.

5. The collapsible canoe of claim 1 further comprising:

a set of auxiliary ribs which may be optionally employed in place of a selected subset of said series of ribs, each of said set of auxiliary ribs corresponding to one of said ribs of said selected subset of said series of ribs, each of said set of auxiliary ribs having a rib length L which is shared by said corresponding one of said ribs.

6. The collapsible canoe of claim 1 wherein said means for tensioning said skin is provided by sizing said series of ribs relative to said skin such that said ribs tension said skin as they are pivoted into position.

7. The collapsible canoe of claim 6 further comprising:

locking clips attached to at least one of said supplemental bottom stringers, said locking clips engaging said ribs when said ribs are pivoted into position to maintain said ribs in such position.

8. The collapsible canoe of claim 7 further comprising:

a pair of side stringers which slidably engage said series of ribs and reside between said supplemental bottom stringers and said pair of gunwales.

9. The collapsible canoe of claim 8 wherein each of said pair of side panels comprises:

a side foam lining of a compliant material.

10. The collapsible canoe of claim 1 wherein said means for stabilizing said pair of stem elements further comprises:

a prong fixably attached to each of said pair of stem elements; and a slot positioned in each of said pair of terminator panels, said slot being positioned so as to engage one of said prongs to stabilize said prong, thereby stabilizing said pair of stem elements with respect to said pair of gunwale terminators.

11. The collapsible canoe of claim 10 wherein said means for stabilizing said pair of stem elements further comprises:

a gunwale terminator cradle provided on each of said pair of stem elements, said gunwale terminator cradle being configured to supportably engage one of said pair of gunwale terminators.

12. The collapsible canoe of claim 1 wherein said means for stabilizing said pair of stem elements further comprises:

a pair of straps attached to said pair of terminator panels; and means for fastening said pair of straps to said pair of stem elements.

13. The collapsible canoe of claim 12 wherein said means for fastening said pair of straps to said pair of stem elements further comprises:

anchoring means affixed to each of said pair of stem elements; and means for adjustably engaging each of said pair of straps with said anchoring means.

14. The collapsible canoe of claim 13 wherein said anchoring means further comprises:

an anchor strap affixed to each of said pair of stem elements, and further wherein said means for adjustably engaging each of said pair of straps with said anchoring means further comprises:

a pair of detaching buckles, each having, a buckle first part which is attached to one of said pair of straps, a buckle second part which is adjustably engaged by one of said anchor straps, and means for detachably engaging said buckle first part and said buckle second part with each other.

15. The collapsible canoe of claim 13 wherein said anchoring means further comprises:

a D-ring affixed with respect to each of said pair of stem elements, and further wherein said means for adjustably engaging each of said pair of straps with said anchoring means further comprises:

a pair of ladder-lock buckles, each of which is adjustably engaged with one of said pair of straps.

16. The collapsible canoe of claim 1 wherein said pair of side panels are attached to each other and to said bottom panel at end seams, further wherein said pair of terminator panels are provided by heat sealable tape applied over said end seams.

17. The collapsible canoe of claim 16 wherein said means for stabilizing said pair of stem elements further comprises:

a prong fixably attached to each of said pair of stem elements; and a slot positioned in each of said pair of terminator panels and extending through one of said end seams, said slot being positioned so as to engage one of said prongs to stabilize said prong, thereby stabilizing said pair of stem elements with respect to said pair of gunwale terminators.

18. The collapsible canoe of claim 17 wherein said means for stabilizing said pair of stem elements further comprises:

a gunwale terminator cradle provided on each of said pair of stem elements, said gunwale terminator cradle being configured to supportably engage one of said pair of gunwale terminators.

* * * * *